US009721469B2

(12) United States Patent
Grotendorst et al.

(10) Patent No.: US 9,721,469 B2
(45) Date of Patent: Aug. 1, 2017

(54) FILTERING INFRASTRUCTURE DESCRIPTION MESSAGES

(71) Applicant: CONTINENTAL TEVES AG & CO. OHG, Frankfurt (DE)

(72) Inventors: Thomas Grotendorst, Eschborn (DE); Marc Menzel, Weimar (DE); Richard Scherping, Liederbach am Taunus (DE); Ulrich Stählin, Eschborn (DE)

(73) Assignee: Continental Teves AG & Co. oHG, Frankfurt (DE)

( * ) Notice: Subject to any disclaimer, the term of this patent is extended or adjusted under 35 U.S.C. 154(b) by 0 days.

(21) Appl. No.: 14/912,448

(22) PCT Filed: Aug. 22, 2014

(86) PCT No.: PCT/EP2014/067950
§ 371 (c)(1),
(2) Date: Feb. 17, 2016

(87) PCT Pub. No.: WO2015/025056
PCT Pub. Date: Feb. 26, 2015

(65) Prior Publication Data

US 2016/0210859 A1 Jul. 21, 2016

(30) Foreign Application Priority Data

Aug. 22, 2013 (DE) ..... 10 2013 216 631

(51) Int. Cl.
*G08G 1/00* (2006.01)
*G08G 1/0967* (2006.01)
(Continued)

(52) U.S. Cl.
CPC ..... *G08G 1/096791* (2013.01); *G08G 1/093* (2013.01); *G08G 1/162* (2013.01);
(Continued)

(58) Field of Classification Search
None
See application file for complete search history.

(56) References Cited

U.S. PATENT DOCUMENTS 6,654,681 B1 11/2003 Kiendl
9,014,921 B2 4/2015 Bretzigheimer
(Continued)

FOREIGN PATENT DOCUMENTS

DE 19903909 8/2000
DE 102004030994 1/2006
(Continued)

OTHER PUBLICATIONS

German Search Report for German Application No. 10 2014 216 796.5 mailed Jun. 1, 2015, including partial translation.
(Continued)

*Primary Examiner* — Adolf Dsouza
(74) *Attorney, Agent, or Firm* — RatnerPrestia

(57) ABSTRACT

A method for filtering infrastructure description messages packed in data packages, the messages being transmitted in a vehicular ad hoc network, along with positional information messages for the localization of individual participating nodes, in order to describe the status of the vehicular ad hoc network and/or a street on which the participating nodes are located. The method includes the following steps: receiving one of the infrastructure description messages at a participating node; evaluating the received infrastructure description message as to whether a response is required; and filtering the evaluated infrastructure description message based on a predetermined criterion for whether a response is required.

11 Claims, 5 Drawing Sheets

(51) Int. Cl.
*G08G 1/09* (2006.01)
*G08G 1/16* (2006.01)

(52) U.S. Cl.
CPC ..... *G08G 1/163* (2013.01); *G08G 1/09675* (2013.01); *G08G 1/096783* (2013.01); *G08G 1/166* (2013.01)

(56) References Cited

U.S. PATENT DOCUMENTS

| | | | | |
|---|---|---|---|---|
| 2011/0140968 | A1* | 6/2011 | Bai | G01S 5/0072 342/454 |
| 2012/0220231 | A1* | 8/2012 | Stahlin | H04L 67/12 455/41.2 |
| 2013/0083679 | A1 | 4/2013 | Krishnaswamy | |
| 2015/0019076 | A1 | 1/2015 | Stahlin | |

FOREIGN PATENT DOCUMENTS

| | | | |
|---|---|---|---|
| DE | 102007032956 | | 2/2009 |
| DE | 102010002092 | | 12/2010 |
| DE | 102011080789 | | 2/2012 |
| JP | 2011529226 | A | 12/2011 |
| WO | 2010011806 | A1 | 1/2010 |
| WO | 2010139526 | | 12/2010 |
| WO | 2013102575 | | 7/2013 |

OTHER PUBLICATIONS

International Search Report for International Application No. PCT/EP2014/067950 mailed Feb. 4, 2015.
Written Opinion of the International Searching Authority for International Application No. PCT/EP2014/067950 mailed Feb. 4, 2015.
Japanese Office Action for Japanese Application No. 2016-535502, dated Feb. 7, 2017, including English translation, 9 pages.

* cited by examiner

FILTERING INFRASTRUCTURE DESCRIPTION MESSAGES

CROSS REFERENCE TO RELATED APPLICATIONS

This application is the U.S. National Phase Application of PCT/EP2014/067950, filed Aug. 22, 2014, which claims priority to German Patent Application No. 10 2013 216 631.1, filed Aug. 22, 2013, the contents of such applications being incorporated by reference herein.

FIELD OF THE INVENTION

The invention relates to a method for filtering a transmission signal, transmitted in a vehicle ad hoc network, that carries at least position data pertaining to subscribers in a vehicle ad hoc network in data packets, to a filter apparatus for performing the method and to a receiver having the filter apparatus.

BACKGROUND OF THE INVENTION

WO 2010/139 526 A1, which is incorporated by reference, discloses a mobile ad hoc network called car2X whose nodes are particular road users, such as vehicles, or other objects in road traffic, such as traffic lights. These networks can be used to provide the road users involved in the car2X network with advice of road traffic states, such as accidents, congestion, hazard situations, etc.

SUMMARY OF THE INVENTION

An aspect of the present invention is to improve the use of such mobile ad hoc networks.

According to one aspect of the invention, a method for filtering infrastructure description messages, packed in data packets, that are sent in a vehicle ad hoc network besides position information messages pertaining to the localization of individual subscriber nodes among one another for the purpose of describing the state of the vehicle ad hoc network and/or of a road on which the subscriber nodes are situated comprises:

- reception of one of the infrastructure description messages at a subscriber node,
- rating of the received infrastructure description message in respect of a need for reaction, and
- filtering of the rated infrastructure description message on the basis of a predetermined criterion for the need for reaction.

The specified method is based on the consideration that messages are sent in a vehicle ad hoc network in order to distribute information among the subscribers. Fundamentally, it is possible to distinguish between two types of information in this case.

A first type of information is intended to be used by a subscriber node of the vehicle ad hoc network to call attention to itself and to fundamentally report its position to other subscribers. Such messages will be called position description messages below, for which, for example, the European standard ETSI EN 302 637-2, which is incorporated by reference, defines a form that allows this first type of information to be distributed among the subscriber nodes in a standardized form. The European standard cites a position description message CAM for "Cooperative Awareness Message" that can optionally carry further information pertaining to the sending subscriber node, such as speed, direction of travel, and so on.

The first type of information carried in position description messages is fundamentally counterbalanced by the second type of information, which describes the surroundings in which a subscriber node is situated. These surroundings are defined by the infrastructure and can adopt various states. In this case, information that describes the infrastructure is intended to include firstly information that relates to the navigation level and to the roadway guidance level on the road. This includes road profile, road signs, but also congestion, traffic accidents, breakdowns, states of the road signs, such as traffic light states, etc. In addition, the infrastructure is also intended to include the vehicle ad hoc network itself, via which the subscriber node can send its messages. This type of second information is intended to be carried in messages, called infrastructure description messages below, of which a multiplicity of different types can be defined.

As an example of an infrastructure description message, the European standard ETSI EN 302 637-3, which is incorporated by reference, defines what are known as decentralized environmental notification messages, called DENM, that can be used by a subscriber node of the vehicle ad hoc network to transmit information pertaining to the state of the road to other subscriber nodes. This state of the road can relate both to the navigation level and to the roadway guidance level, for example with congestion reports, accident reports or the like. What are known as MAP or TOPO messages can be used to send information that can describe the infrastructure in the form of the topology of the road among the subscriber nodes of the vehicle ad hoc network. What are known as SPAT messages can be used to describe the infrastructure in the form of states of light signal installations such as traffic lights on the road. What are known as service announcement messages, called messages, can be used to describe the infrastructure among the subscriber nodes in the form of descriptions pertaining to the supply of the vehicle ad hoc network. By way of example, it is thus possible to indicate services that are normally handled on separate channels.

The handling of infrastructure description messages is comparatively computation intensive, since, unlike in the aforementioned position information messages, it is additionally necessary to evaluate the information describing the infrastructure and to react thereto accordingly. In high-load situations on the vehicle ad hoc network, this can result in safety-relevant messages not being processed in good time if insufficient computation resources are available. Alternatively, although the communication system could have its computation resources designed for the extreme case of the high-load situation, this approach is more likely to be rejected from an economic standpoint.

The specified method therefore involves taking another path and proposing to filter out the infrastructure description messages on the basis of a predetermined criterion that describes a need for reaction for a received infrastructure description message.

The predetermined criterion for the need for reaction can arise from various perspectives. If a subscriber node receives an infrastructure description message yet again, for example, then little need for reaction can be assumed, because the information in the infrastructure description message is redundant for the subscriber node. Such an approach can fundamentally be pursued in the case of the aforementioned MAP and TOPO messages, since the topology of the road or surroundings that is described with these messages hardly ever changes. A similar process can also be used with the other messages, such as the DENMs, however, if they report an accident yet again for safety reasons, for example in order to compensate for transmission errors. Infrastructure description messages can also be received twice, and hence repeatedly, on account of parallel hopping paths.

The predetermined criterion for the need for reaction can also be designed on a time-dependent basis, for example. By way of example, it is thus possible for the aforementioned SPAT messages to have a period configured for them in which incoming SPAT messages from a complex of light signal installations are filtered and hence ignored if a SPAT message has already been received from this complex. After the period, an incoming SPAT message from the same complex of light signal installations can be re-examined for its need for reaction and hence relevance.

A further option would be for particular types of infrastructure description messages to be filtered completely, and hence ignored, under particular circumstances, such as in the aforementioned high-load situation, because they are not relevant to safety and hence it can always be assumed that there is no need for reaction.

It goes without saying that the predetermined criterion for the reaction speed can also take account of prioritizations within a particular message type that rate information. By way of example, in the transport header of an aforementioned DENM, it is already possible to identify the type (weather warning, emergency vehicle, etc.). Feedback from the functions that are active in the vehicle about currently relevant types (arises from actually evaluated types and the prioritization of various functions among one another) is taken as a basis for performing classification into relevant and currently irrelevant DENMs. In high-load situations, local forwarding of such infrastructure description messages having low-priority information can be prevented.

In order to define the predetermined criterion pertaining to the need for reaction, the need for reaction itself should be defined first of all, however.

In one development of the specified method, the need for reaction describes at least one potential with which the receiving subscriber node can react to the state description contained in the infrastructure description message. That is to say that a reaction from the subscriber node is not actually necessary if there is absolutely no opportunity to react to the information reported in an infrastructure description message. This is the case, for example, when an accident is reported but the receiving subscriber node is likewise a party that is involved in the accident. In this case, the predetermined criterion can comprise a limiting condition with which the receiving subscriber node is intended to react to the state description contained in the infrastructure description message.

In another development of the specified method, the need for reaction describes at least one currentness for the state description in the infrastructure description message. When a subscriber node in the form of a vehicle, for example, moves away from the aforementioned accident, a corresponding infrastructure description message reporting the accident is irrelevant to the vehicle even if the vehicle is still in direct proximity to this accident. Alternatively or additionally, the currentness for the state description could contain whether the same infrastructure description message has been received once before. In this case, the received infrastructure description message per se could be eliminated as redundant. The predetermined criterion can then comprise a limiting condition for the currentness describing the state description in the infrastructure description message.

In yet another development of the specified method, the need for reaction contains at least one distance between the receiving subscriber node and a position contained in the state description of the infrastructure description message. This means that it is possible to eliminate, by way of example, infrastructure description messages having reports that relate to events and/or topologies that are too far away from the subscriber node for a reaction by the subscriber node to be necessary. In this case, the predetermined criterion can contain a limiting condition for the distance between the receiving subscriber node and the position contained in the state description of the infrastructure description message.

According to a further aspect of the invention, a filter apparatus is set up to perform a method as claimed in one of the preceding claims.

In one development of the specified filter apparatus, the specified apparatus has a memory and a processor. In this case, the specified method is stored in the memory in the form of a computer program, and the processor is provided for carrying out the method when the computer program is loaded into the processor from the memory.

According to a further aspect of the invention, a computer program comprises program code means in order to perform all the steps of one of the specified methods when the computer program is executed on a computer or one of the specified apparatuses.

According to a further aspect of the invention, a computer program product contains a program code that is stored on a computer-readable data storage medium and that, when executed on a data processing device, performs one of the specified methods.

According to a further aspect of the invention, a receiver for a vehicle for receiving messages, packed in data packets, with a transmission signal in a vehicle ad hoc network comprises:

an antenna for receiving the transmission signal, one of the specified filter apparatuses for filtering at least some of the data packets from the transmission signal, and a presentation apparatus for extracting the messages from the filtered data packets.

According to another aspect of the invention, a vehicle comprises one of the specified receivers.

A further aspect of the invention, which relates to a selection method for reducing the computation complexity of a vehicle-to-X communication system according to the preamble of principle 1, will be explained below.

The prior art discloses what are known as vehicle-to-X communication systems that are designed for transmitting both traffic-related data and various service data, such as entertainment applications. In this case, the vehicle-to-X communication is based both on the data interchange between vehicles themselves (vehicle-to-vehicle communication) and on the data interchange between vehicles and infrastructure devices (vehicle-to-infrastructure communication). On account of the high demands on the reliability and data integrity of information transmitted by means of vehicle-to-X communication, such information is additionally often provided with a complex security signature or data encryption.

The evaluation of such a security signature and the decoding of such data encryption are associated with a relatively high level of computation complexity, however.

Added to this is the occurrence of special situations, such as passage through a busy urban junction at rush hour, in which a number of vehicle-to-X messages is received that is so large that processing of all vehicle-to-X messages received is likewise possible only through the provision of a comparatively high level of computation power. In order to keep the computation complexity and hence the purchase costs for a computation module for such a vehicle-to-X communication system as low as possible, the prior art additionally discloses various preprocessing methods that make a selection for the vehicle-to-X messages that are to be decoded from among all received vehicle-to-X messages. However, such preprocessing methods relate only to the so-called cooperative awareness messages (CAMs) that are interchanged between the vehicles themselves, and accordingly use data packets that are typically contained only in CAMs for preprocessing.

Generally, the European vehicle-to-X communication standardization defines different message types. As already described, previous work pertaining to the preprocessing of received data concentrates largely on CAMs, since, particularly in situations with many vehicles, these are the majority of the received packets and, on account of the direct relationship between the sender of the packet and information that is included, provide a multiplicity of filter options or preprocessing options.

Particularly in regions with an existing vehicle-to-X communication infrastructure, such as junctions controlled by traffic lights, a significant number of further vehicle-to-X messages of the following types can also be expected, however:

- decentralized environmental notification message (DENM)
- road topology (MAP, called TOPO earlier)
- signal phase and timing (SPAT)
- service announcements (SA), particularly service channels, SCHs An aspect of the invention aims to reduce the computation complexity of a vehicle-to-X communication system for these types of received vehicle-to-X messages too.

For the cited types of vehicle-to-X messages, the invention provides the following methods of preprocessing:

DENMs:

The network header of a DENM reveals the destination area of this message without further decoding complexity. If the inherent position, i.e. the position of the receiving vehicle or vehicle-to-X communication system, is not situated in this area, the relevance can be assumed to be low, which means that this vehicle-to-X message is not handled further and is rejected. Specifically, this means that the vehicle-to-X message is not forwarded from the network layer of the vehicle-to-X communication system to what are known as facilities or applications or vehicle systems, particularly is not forwarded in high-load situations. Furthermore, the transport header of a DENM already reveals the type of DENM (e.g. weather warning, emergency vehicle, etc.). A status report from the facilities or applications or vehicle systems that are active in the vehicle about currently relevant types (this is evident from actually evaluated types of DENMs and the prioritization of various vehicle systems among one another) is taken as a basis for performing classification into DENMs that are relevant and currently not relevant. In high-load situations, it is possible, in this case, for DENMs that are not relevant not to be forwarded locally within the vehicle-to-X communication system, which means that they are rejected. Furthermore, according to the currently existing specification, DENMs are periodically repeated without content updates in order to compensate for transmission errors. These repetitions are filtered out according to the invention, and the corresponding DENMs are therefore not processed and rejected. The same applies to what are known as doubling instances, which arise as a result of parallel transmission paths or what are known as hopping paths.

MAP/TOPO:

Infrastructure components that are capable of vehicle-to-X communication periodically transmit the road topology at particular locations, such as junctions. Since these data hardly ever change, repeated transmissions are preferably filtered out.

SPAT:

Vehicle-to-X messages that contain information about the current phase and future phases of light signal installations are needed both for safety functions (red light warning) and for convenience functions (traffic light phase assistant). A reduction in the load by SPAT messages therefore takes place, as a result of updated messages pertaining to a complex of light signal installations being filtered out, preferably only when relevant facilities or applications or vehicle systems in the vehicle provide notification that these installations are currently not relevant to them. After a configurable period has elapsed, a message is particularly preferably forwarded again in order to recheck the validity of the assumption of non-relevance. A suitable vehicle system for assessing the relevance of a traffic light installation is a navigation system having a route planner, for example, that identifies that the traffic light installation is not situated on the route of the vehicle.

SA:

Service announcements describe optional services that are normally handled via separate channels (service channels, SCHs). In high-load situations, these SAs are preferably filtered out, particularly filtered out upstream of the network&transport component, since SAs are not safety-relevant and there would not be sufficient computation power available to process them further in a high-load situation anyway.

SCH:

The contents of the vehicle-to-X messages received via the service channels are optional, not safety-relevant and are also needed only when corresponding services are used. In the standard case, therefore, what is known as a driver of the hardware module used for communication, e.g. of the WLAN chip, is actually instructed not to forward these vehicle-to-X messages to further protocol layers of the vehicle-to-X communication system.

Preferably, vehicle-to-X messages are filtered out as early as possible in the data-processing order or in the network stack. If e.g. no forwarding by the network&transport component (network layer) to other communication subscribers is necessary, vehicle-to-X messages can actually be rejected upstream of this component (i.e. between access technologies and network&transport or in individual cases directly in the access technologies). Otherwise, the vehicle-to-X messages are preferably rejected thereafter, but still upstream of the facilities component. Within the context of the invention, the term "local forwarding" denotes the forwarding from network&transport to facilities.

In this case, the individual components of the network stack or of the data-processing order preferably correspond to the specification according to ETSI and C2C-CC.

The method according to the further aspect of the invention therefore results in the advantage that the early filtering of vehicle-to-X special messages means that the necessary computation power and the volume of data to be processed can be reduced. This allows the use of cheaper computation units and data interfaces. Conversely, in vehicle-to-X communication systems that would normally be totally unable to process certain special messages on account of data rate limitations or computation power limitations (e.g. upgrade solutions), the filtering or preprocessing described here can allow additional functions.

BRIEF DESCRIPTION OF THE DRAWINGS

The properties, features and advantages of this invention that are described above and also the manner in which they are achieved will become clearer and more distinctly comprehensible in connection with the description of the exemplary embodiments that follows, said exemplary embodiments being explained in more detail in connection with the drawings, in which.

DETAILED DESCRIPTION OF THE INVENTION

In the figures, like technical elements are provided with like reference symbols and described only once.

Figure 3:
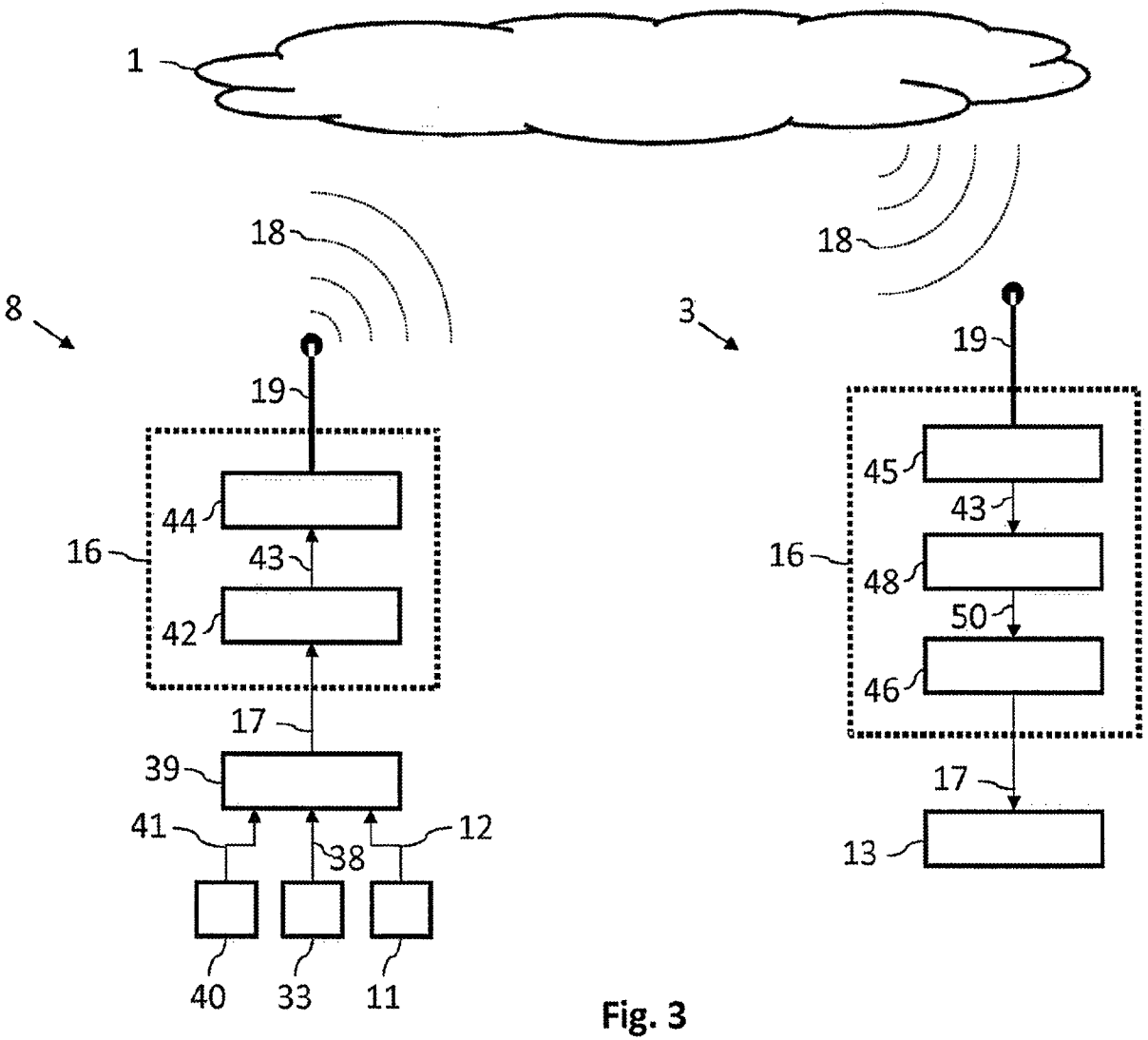
FIG. 3 shows a basic illustration of a vehicle ad hoc network in which the vehicle from FIGS. 1 and 2 can be involved.

The invention relates to a network protocol for a vehicle ad hoc network shown in FIG. 3, which is called car2X network 1 below for the sake of simplicity. To provide a better understanding of the technical background to this car2X network 1, a nonrestrictive exemplary application will first of all be provided for this car2X network 1 before discussing technical details pertaining thereto in more detail.

Figure 1:
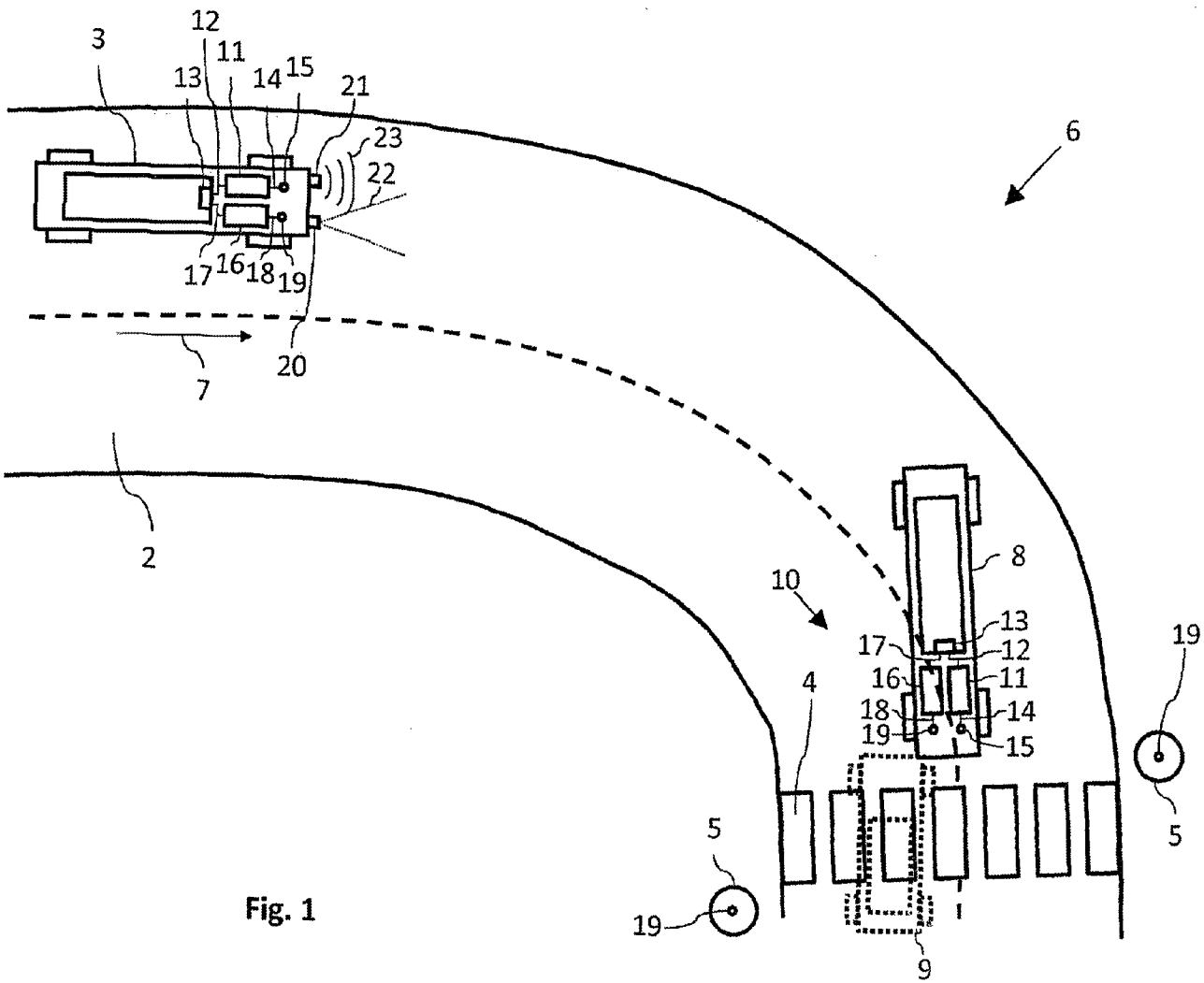
FIG. 1 shows a basic illustration of a vehicle traveling on a road.

Therefore, reference is made to FIG. 1, which shows a basic illustration of a vehicle 3 traveling on a road 2.

In the present embodiment, the road 2 is meant to have a pedestrian crossing 4 at which a set of traffic lights 5 is used to regulate whether the vehicle 4 on the road 2 is permitted to cross the pedestrian crossing 4 or a pedestrian—not shown in more detail—on the pedestrian crossing 4 is permitted to cross the road 2. Between the pedestrian crossing 4 and the set of traffic lights 5, there is, for the purposes of the present embodiment, an obstacle in the form of a curve 6 that conceals the pedestrian crossing 4 from the driver of the vehicle 3 and from an ambient sensor system—which is yet to be described—of the vehicle 3.

In a direction of travel 7 ahead of the vehicle 3, FIG. 1 shows a further vehicle 8 that has been involved in a road accident 10 with a vehicle 9—shown in dots—on the pedestrian crossing 4 and is blocking the lane in the direction of travel 7 of the vehicle 3.

The pedestrian crossing 4 and the road accident 10 are hazard situations on the road 2. If the driver of the vehicle 3 overlooks the pedestrian crossing 4 and therefore illegally fails to stop before it, he could hit a pedestrian who is crossing the pedestrian crossing 4 and who, in crossing the pedestrian crossing 4, relies on the driver of the vehicle 3 behaving in accordance with the rules. In both hazard situations, the driver of the vehicle 3 must stop the vehicle 3 in order to avoid a collision with the hazard object in the hazard situation, that is to say the pedestrian and/or the further vehicle 8. To this end, the car2X network 1 can be used, which will be discussed in more detail at a later juncture.

In the present embodiment, the vehicle 3 has a receiver 11 for a global satellite navigation system, called a GNSS receiver 11 below, which the vehicle 3 can use in a manner known per se to determine position data in the form of its absolute geographical position 12 and to use said position data for the purposes of a navigation system 13, for example, in order to display them on a geographical map, which is not shown further. Corresponding signals 14 from the global satellite navigation system, called GNSS signals 14 below, can be received via an appropriate GNSS antenna 15, for example, and forwarded to the GNSS receiver 11 in a manner known per se.

In the present embodiment, the vehicle additionally has a transceiver 16 that the vehicle 3 can use to be involved as a node in the car2X network 1 and to interchange messages, called car2X messages 17 below, with other nodes, such as the further vehicle 8 and/or the set of traffic lights 5. In order to distinguish it from the GNSS receiver 11, this transceiver 16 will be called car2X transceiver 16 below.

In the car2X messages 17 interchanged via the car2X network 1, the individual nodes 3, 5, 8 can interchange data describing various information with one another, which data can be used to increase road safety on the road 2, for example. An example of the information that can be interchanged with the data in the car2X messages 17 would be the absolute geographical position 12, determined using the GNSS receiver 11, of the respective node 3, 5, 8 of the car2X network 1. Such data can also be called position data. If the node 3, 5, 8 of the car2X network 1 that receives the geographical position 12 is a vehicle, such as the vehicle 3 that is not involved in the road accident 10 and the vehicle 8 that is involved in the road accident 10, then the geographical position 12 received via the car2X network 1 can be used to represent the traffic movement, for example, on the navigation system 13 of the receiving vehicle 3, 8, for example. If, besides the absolute geographical position 12, the road accident 10 is also described as information with the data in the car2X message 17, then determined traffic situations, such as the road accident 10, can be represented on the navigation system 13 more specifically. Further possible information that can be interchanged with the car2X messages 17 will be discussed in more detail later for the purposes of FIG. 2.

Figure 2:
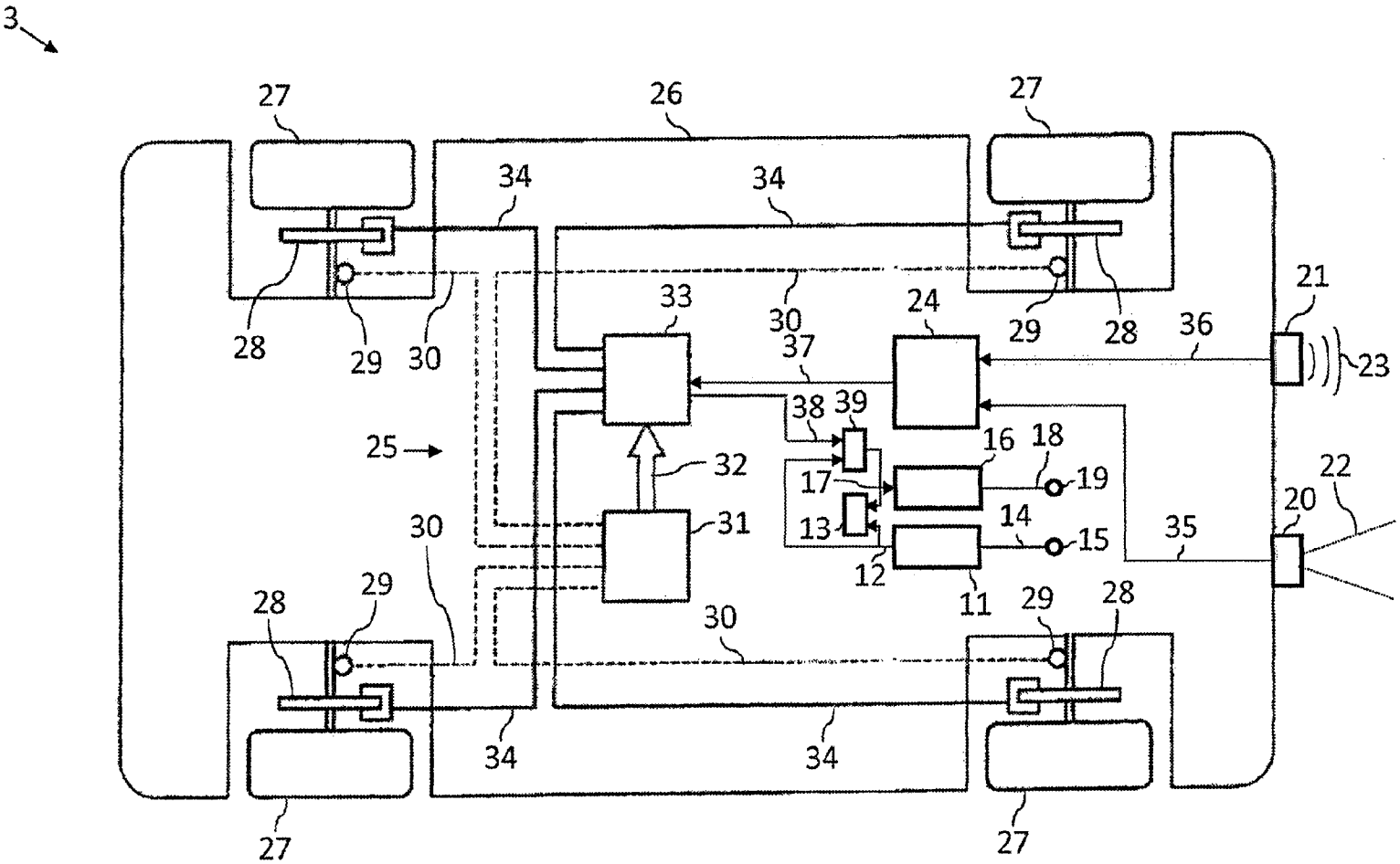
FIG. 2 shows a basic illustration of the vehicle from FIG. 1.

In order to interchange the car2X messages 17, the car2X transceiver 16 either modulates a car2X message 17 onto a transmission signal, called car2X signal 18 below, and sends it via an antenna, called car2X antenna 19 below, to the other nodes 3, 5, 8 in the car2X network 1, or it uses the car2X antenna 19 to receive a car2X signal 18 and filters the relevant car2X message 17 therefrom. This will be discussed in more detail at a later juncture for the purposes of FIG. 3. In this case, FIG. 1 shows that the car2X transceiver 16 outputs a car2X message 17 to the navigation system 13 on the assumption that said message contains, in the manner described above, information that can be represented on said navigation system. This is not intended to be understood as a restriction, however. In particular, it is expediently also possible for the GNSS receiver 11 to be connected to the car2X transceiver 16 directly or, as shown in FIG. 2, indirectly in order to send its own absolute geographical position 12 in the car2X network 1.

The structure of the car2X message 17 and of the car2X signal 18 and hence the design of the car2X network can be defined in a communication protocol. There are already such communication protocols on a country-specific basis, inter alia for the purposes of ETSI TC ITS at ETSI in Europe and for the purposes of IEEE 1609 at IEEE and also at SAE in the United States of America. Further information in this regard can be found in the cited specifications.

The vehicle 3 can optionally also have the aforementioned ambient sensor system in the form of a camera 20 and a radar sensor 21. The camera 20 can be used by the vehicle 3 to record an image of a view that is ahead of the vehicle 3, when considered in the direction of travel 7 of the vehicle 3, within an image angle 22. In addition, the vehicle 3 can use the radar sensor 21 and appropriate radar beams 23 to identify objects, when considered in the direction of travel 7 of the vehicle 3, and to determine the distance from the vehicle 3 in a manner known per se.

In order to substantiate the information that can be transmitted with a car2X message 17, the design of the vehicle 3 and of the further vehicle 5 will first of all be discussed below on the basis of the vehicle 3 by way of example. The vehicle 3 has various safety components, of which FIG. 2 shows an electronic braking assistant 24, called EBA 24, and a driving dynamics control system 25, which is known per se. While DE 10 2004 030 994 A1 provides details pertaining to the EBA 24, DE 10 2011 080 789 A1 provides details pertaining to the driving dynamics control system 25.

The vehicle 3 comprises a chassis 26 and four wheels 27. Each wheel 27 can be slowed down in comparison with the chassis 26 by means of a brake 28, mounted at a fixed location on the chassis 26, in order to slow down a movement by the vehicle 3 on the road 2.

In this case, in a manner that is known to a person skilled in the art, it may occur that the wheels 27 of the vehicle 3 lose their traction and the vehicle 3 even moves away from a trajectory, for example prescribed by means of a steering wheel, which is not shown further, as a result of understeer or oversteer. This is avoided by the driving dynamics control system 25.

In the present embodiment, the vehicle 4 has speed sensors 29 on the wheels 27 for this purpose, which sense a speed 30 of the wheels 27.

On the basis of the sensed speeds 30, a controller 31 can determine, in a manner that is known to a person skilled in the art, whether the vehicle 3 slips on the roadway or even deviates from the aforementioned prescribed trajectory, and can react thereto accordingly with a controller output signal 32 that is known per se. The controller output signal 32 can then be used by an actuating device 33 in order to use actuating signals 34 to actuate actuating elements, such as the brakes 28, which react to the slipping and the deviation from the prescribed trajectory in a manner that is known per se.

The EBA 24 can evaluate image data 35, captured using the camera 20, and distance data 36, captured using the radar sensor 21, pertaining to objects such as vehicles in the direction of travel 7 ahead of the vehicle 3 and, on the basis thereof, can detect a hazard situation. This hazard situation could arise, by way of example, when an object ahead of the vehicle 3 approaches the latter at an excessive speed. In such a case, the EBA 24 could use an emergency braking signal 37 to instruct the actuating device 33 to use the actuating signals 34 to carry out emergency braking with the brakes 28.

Each time the EBA 24 or the driving dynamics control system 25 uses the actuating device 33 to take action in the vehicle 4, the actuating device 33 can output a report signal 38, for example, which is shown in dots in FIG. 2. Expediently, the report signal 38 should substantiate whether the action was required by the EBA 24 or the driving dynamics control system 25. Such a report signal 38 can be produced by any entity in the vehicle 3, that is to say even by the controller 31 of the driving dynamics control system 25, for example. A message generation device 39 could then take the report signal 38, the absolute geographical position 12 and a timestamp 41, which is shown in FIG. 3 and output from a timer 40, as a basis for generating a car2X message 17 that can be used to report the action of the EBA 24 and/or of the driving dynamics control system 25 to the other nodes 5, 8 as information via the car2X network 1. The car2X message 17 generated in this manner could then be sent in the car2X network 1 via the car2X antenna 19.

In the example of FIG. 1, it was explained that the information about the absolute geographical position 12 of the individual nodes 3, 5, 8 and/or about events such as the road accident 10 and/or such as an action by the EBA 24 and/or the driving dynamics control system 25 that is interchanged in the car2X messages 17 could be represented on the navigation system 13 for the purpose of orienting the driver. Alternatively or additionally, the information interchanged in the car 2X messages 17 can also be taken as a basis for actively generating actuating signals 34, for example using the actuating device 33, however. If, by way of example, the action by the EBA 24 is transmitted as information in a car 2X message 17, then it would be possible, by way of example, to take the reception of this car 2X message 17 as a basis for automatically triggering the EBA 24 in the receiving vehicle 3, 8.

The transmission of a car 2X message 17 via the car 2X network 1 will be explained below with reference to FIG. 3, said car 2X network being indicated by a cloud in FIG. 3 for the sake of clarity. The content of the car 2X message 17 is intended to be assumed to be, by way of example, an action—reported by the actuating device 33 with the report signal 38—by the EBA 24 in the accident vehicle 8 involved in the road accident 10.

As already explained, the message generation device 39 takes the report signal 38, the absolute geographical position 12 and the timestamp 41 as a basis for generating the car 2X message 17 according to the aforementioned communication protocol. In this case, the message generation device 39 may also be part of the car 2X transceiver 16, in principle.

From the car 2X message 17, data packets 43 are generated in a data packet generation device 42 in the car 2X transceiver 16 of the accident vehicle 8. The generation of data packets 43 means that car 2X messages 17 from various applications in the accident vehicle 8 can be combined to form a single data stream in order to produce the car 2X signal 18. The data packet generation device 42 therefore corresponds to a network and transport layer, the task of which is known to be to route the network data from various applications. The design of the data packet generation device 42 is dependent on the aforementioned specification of the communication protocol for the car 2X network 1.

The generated data packets 43 are modulated onto the car 2X signal 18 in a modulation device 44 and wirelessly sent in the car 2X network 1. The modulation device 44 therefore corresponds to an interface layer, the task of which is to physically connect the accident vehicle 8 to the car 2X network 1. The design of the modulation device 44 is also dependent on the aforementioned specification of the communication protocol for the car 2X network 1.

In the vehicle 3 that is not involved in the road accident 10, the car 2X signal 18 sent by the accident vehicle 8 can then be received via the car 2X antenna 19.

In order to extract the car2X message 17 from the car2X signal 18, the car2X transceiver 16 of the vehicle 3 has a demodulation device 45 that reverses the sender-end modulation of the data packets 43 in a manner that is known per se. Accordingly, a message extraction device 46 can extract the car2X messages 17 from the data packets 43 and make them available to the applications in the vehicle 3, such as the navigation system 13 or even the actuating device 33. Ultimately, the demodulation device 45 and the message extraction device 46 are the reception-end counterparts in accordance with the aforementioned network and transport layer and the interface layer and are likewise dependent on the aforementioned specification of the communication protocol for the car2X network 1.

For details of the individual network layers, reference is therefore made to the relevant specifications.

Particularly in high-load situations when there are a multiplicity of nodes 3, 5, 8 in the car2X network 1 on the road 2, it is necessary for correspondingly high levels of computation resources to be kept free in the respective nodes 3, 5, 8 for the purpose of processing all car2X messages 17 sent in the car2X network 1, in order to guarantee the processing of all car2X messages 17 at the receiver end within particular time limits. The provision of these high levels of computation resources is associated with a correspondingly high outlay in terms of cost, which is intended to be reduced for the purposes of the present embodiment by the introduction of an initial filter 48.

The concept behind the initial filter 48 is for potentially irrelevant car2X messages 17 to be eliminated as early as possible in order to avoid their needing to be processed unnecessarily by an element in the reception chain because, as it is, they contain information that is irrelevant to the receiving node.

To this end, for the purposes of the present exemplary embodiment, is recognized that the car2X messages 17 can fundamentally be divided into position information messages and infrastructure description messages.

While the subscriber nodes 3, 5, 8 of the car2X network use car2X messages 17 in the form of position information messages to call attention to themselves and can fundamentally report their geographical position 12 to other subscriber nodes 3, 5, 8 for coordination purposes, the subscriber nodes 3, 5, 8 can use car2X messages 17 in the form of infrastructure description messages to describe the surroundings in which they are situated. These surroundings are defined by the infrastructure and can adopt various states. In this case, the infrastructure is intended to be understood comprehensively to mean not just the surroundings, such as the road 2, in which the subscriber node 3, 5, 8 can be locally situated, but also the car2X network 1 via which the subscriber node 3, 5, 8 can send its car2X messages 17. While infrastructure description messages relating to the road 2 can be used to control a subscriber node 3, 8 in the form of a vehicle at navigation level and/or at roadway guidance level, infrastructure description messages relating to the car2X network 1 are used to control and/or signal information flows in the car2X network 1.

A typical infrastructure description message is what are known as the decentralized environmental notification messages, called DENM, defined in the ETSI EN 302 637-3 standard, which can be used by a subscriber node 3, 5, 8 of the car2X network 1 to transmit information pertaining to the state of the road to other subscriber nodes 3, 5, 8.

For the purposes of an embodiment that is discussed below with reference to FIG. 4, it will be assumed that the vehicle 3 in FIG. 1 that is not involved in the accident receives from the accident vehicle 8 two data packets 43 that each carry one of the aforementioned DENMs as a car2X message 17, both of which are intended to report on the accident 10. In this case, each message comprises a message header 51, also called a header, and a message body 52 that carries the information actually of interest and hence the car2X message 17. The data of the message body 52 are also called payload data.

The aim of the filter 48 is to filter the data packets 43 on reception without the payload data from the message body 52 needing to be inspected. Although it would be conceivable for even some of the payload data 52 to be taken into consideration as well during the filtering, the further a data packet 43 needs to be unpacked in the filter 48 in order to decide on the filtering, the more computation complexity the filtering involves, which is inconsistent with the actual aim of the filtering to save computation resources. In the present case, therefore, the message body 52 is intended to be ignored and the filtering is intended to be performed only on the basis of the message header 51.

The message header 51 of a data packet 43 carrying a car2X message 17 in the form of a DENM has a multiplicity of different information variables 53 that can be used to provide predetermined details relating to the car2X message 17 that is carried. By way of example, such details comprise the geographical position 12 of the sender 8 of the car2X message 17 that the sender 8 was in when it sent the car2X message 17, the timestamp 41 with the time at which the car2X message 17 was sent and a message identifier 54 that can accurately qualify the type of the car2X message 17 in any manner. This message identifier 54 will be discussed in more detail at a later juncture. Finally, the details can also comprise a sender identifier that describes information pertaining to the sender 8 itself in more detail, for example what kind of sender (road sign, vehicle, etc.) is involved. These and further details in the information variables 53 of the message header 51 of a data packet 43 are defined for car2X messages 17 in the form of DENMs, for example in the aforementioned standard, for which reason they will not be discussed any more below.

If the accident vehicle 8 now sends car2X messages 17 reporting on the accident 10 in the form of DENMs, the filter 48 can, following reception of a first data packet 43 having a car2X message 17 reporting on the accident 10, filter out all subsequent identically received data packets 43 having car2X messages 17 reporting on this accident 10.

Figure 4:
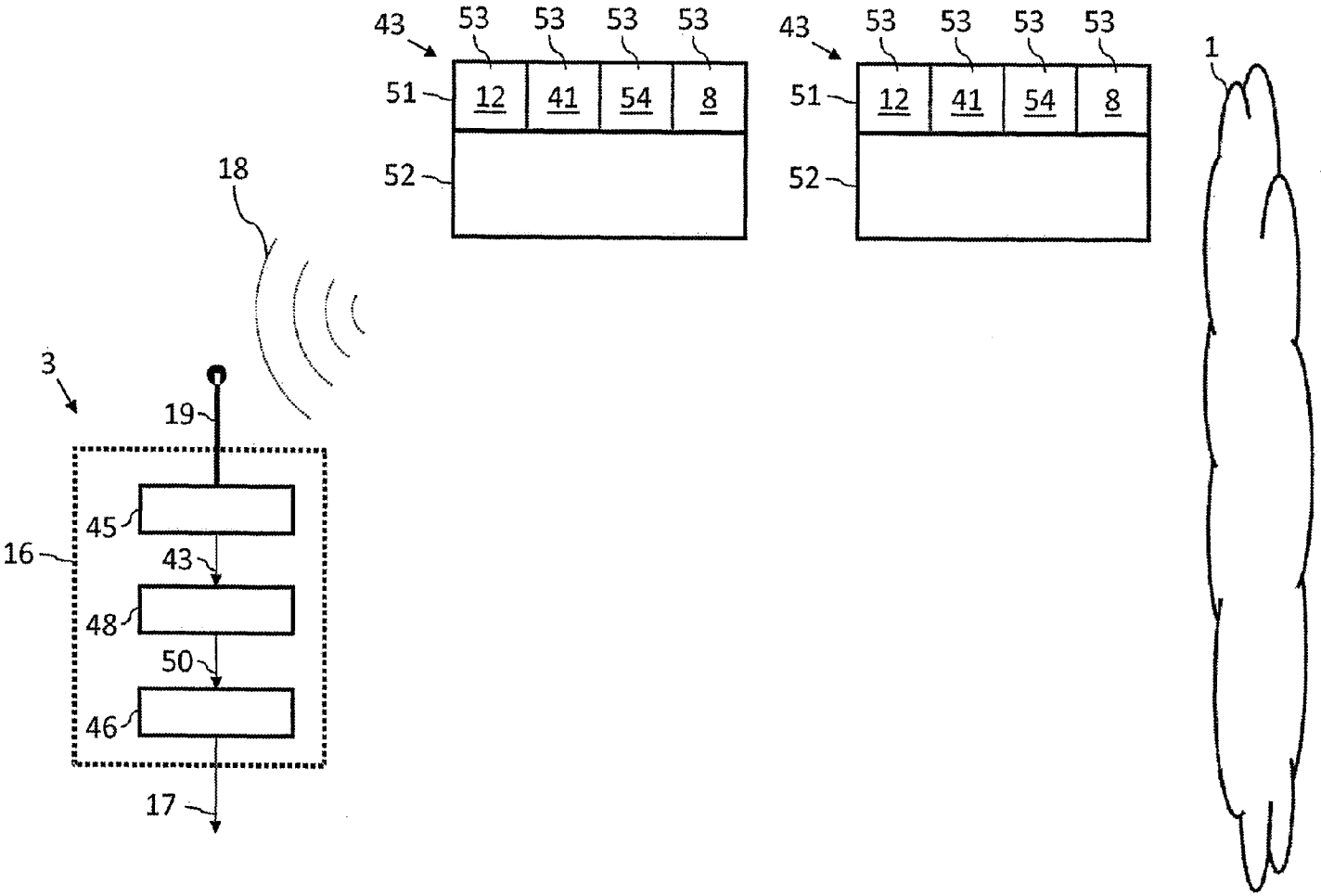
FIG. 4 shows a basic illustration of data packets transmitted in the vehicle ad hoc network from FIG. 3.

If the vehicle 3 that is not involved in the accident receives two different data packets 43, for example, that both report on the accident 10, then this can be deduced in the filter 48 from the message identifier 54 in connection with the sender identifier (provided with the reference symbol 8 in FIG. 4 for the accident vehicle). In addition, the accident vehicle 8 will also not change geographical position 12 when sending the data packets 43. Consequently, the second data packet 43 can be identified as a DENM reporting the accident 10 without decrypting the message body 52, said DENM being known on account of the already received first data packet 43, however, for which reason the second data packet 43 can immediately be rejected as redundant in the filter 48. Only the first data packet 43 then needs to be output to the message extraction device 46 as filtered data packet 50 for further handling.

In the same way, it is also possible for other data packets 43, such as the first data packet 43, to be filtered out as redundant. In this regard, it is possible, by way of example, to assume the scenario that the vehicle 3 that is not involved in the accident 10 has just traveled past the accident 10 but is still situated in direct proximity thereto. The fact that the report is on an accident per se is initially evident in non-specific terms from the message identifier 54 in the message header 51. The message header 51 also reveals the geographical position 12 of the accident, which remains unspecified. Since the vehicle 3 that is not involved in the accident has traveled past the accident 10, however, this being evident from the direction of travel 7, for example, the vehicle 3 that is not involved in the accident 10 can, in the scenario that now exists, also immediately eliminate the first data packet 43 as not relevant, because it can no longer collide with the accident 10 on account of the direction of travel 7 that is remote from the accident. The accident 10 itself then no longer needs to be unpacked from the message body 52.

The filtering in the filter 48 ultimately needs to be provided with a decision basis regarding from when it can classify a data packet 43 as irrelevant without knowledge of the infrastructure description message itself that is carried therein. The decision basis should be chosen on the basis of the insight that an infrastructure description message is intended to bring about a reaction from the individual subscriber nodes 3, 5, 8 in a certain manner by virtue of the aforementioned notification of particular states on the road 2 and/or in the car2X network 1. To this end, the state on the road 2 and/or in the car2X network 1 that is reported in the data packet 43 must have a corresponding influence on the relevant subscriber node 3, 5, 8, however. In other words, the state on the road 2 and/or in the car2X network 1 that is reported in the data packet 43 must require a reaction from the receiving subscriber node 3, 5, 8. If this is not the case, that is to say if the subscriber node 3, 5, 8 does not have to react to the state, then the relevant data packet 43 reporting the state is irrelevant to the subscriber node 3, 5, 8.

It is therefore proposed that the decision basis defined is a relevant need for reaction with which a subscriber node 3, 5, 8 must react to a state reported in a data packet 43 having an infrastructure description message. If it can be assumed that the subscriber node 3, 5, 8, as in the first case, explained previously, already knows the content of the infrastructure description message, then the latter also does not need to be processed further, since it can be assumed that any necessary reaction has already been initiated.

Figure 5:
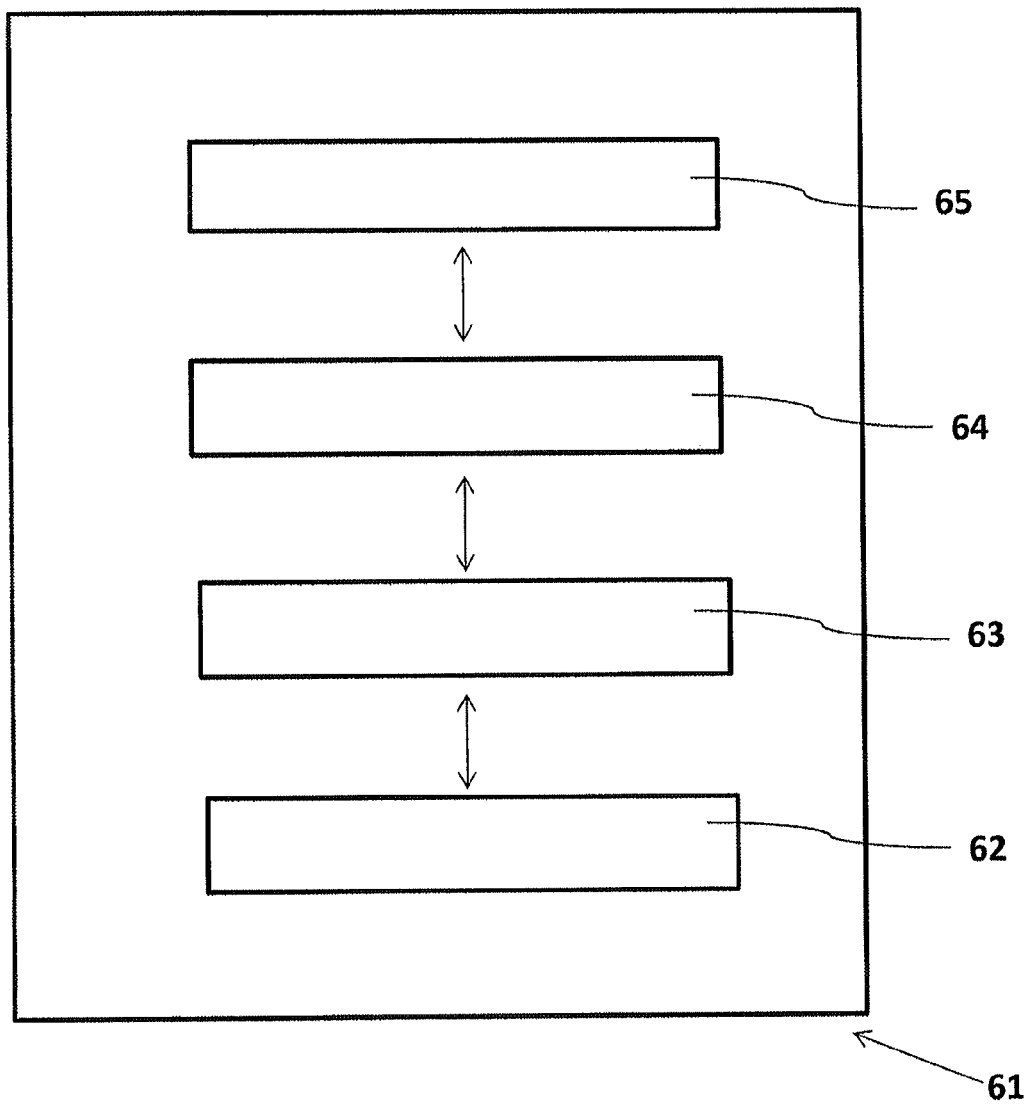
FIG. 5 shows an example of the design of a network stack.

FIG. 5 shows an example of the design of network stack 61. Network stack 61 first of all comprises data input process 62, which is used to identify and detect wirelessly received vehicle-to-X messages as such. By way of example, the vehicle-to-X messages are received by means of mobile radio and WLAN. Data input process 62 forwards the detected vehicle-to-X messages to data management process 64 via network and transport process 63. Data management process 64 usually performs a first evaluation of the data of the received vehicle-to-X messages, the data contents of the detected vehicle-to-X messages being collected, sorted and if need be forwarded to relevant communication-based application processes 65. Application process 65 is the so-called facilities or applications or vehicle systems.

The further aspect of the invention can also be described on the basis of the following principles:

1. A selection method for reducing the computation complexity of a vehicle-to-X communication system, wherein the vehicle-to-X communication system is used to receive and/or send different types of vehicle-to-X messages and wherein the vehicle-to-X messages comprise information about the types of the vehicle-to-X messages, characterized in that the received vehicle-to-X messages to be processed are selected by taking account of their types.

2. The method according to principle 1, characterized in that the vehicle-to-X messages to be processed are additionally selected by taking account of a current computation load on the vehicle-to-X communication system.

3. The method according to at least one of principles 1 and 2, characterized in that the vehicle-to-X messages to be processed are additionally selected by taking account of a traffic situation in which a motor vehicle that is equipped with the vehicle-to-X communication system is situated.

4. The method according to at least one of principles 1 to 3, characterized in that a destination area that is contained in the received vehicle-to-X message in unencrypted form and that specifies a region in which the received vehicle-to-X message is relevant is used for the selection.

5. The method according to at least one of principles 1 to 4, characterized in that vehicle systems and/or functions activated in the motor vehicle are used for the selection.

6. The method according to at least one of principles 1 to 5, characterized in that repeatedly received identical vehicle-to-X messages are processed only once.

7. The method according to at least one of principles 1 to 6, characterized in that a planned journey route for the motor vehicle is used for the selection.

8. The method according to at least one of principles 1 to 7, characterized in that vehicle-to-X messages that are associated with optional services are rejected completely in high-load situations.

9. The method according to at least one of principles 1 to 8, characterized in that the selection is actually made by a driver of a receiving module of the vehicle-to-X communication system.

10. The method according to at least one of principles 1 to 9, characterized in that the types of vehicle-to-X messages are what are known as decentralized environmental notification message (DENM), road topology (MAP) and signal phase and timing (SPAT) service announcements (SA), particularly service channels (SCHs).

The invention claimed is:

1. A method for filtering infrastructure description messages, packed in data packets, that are sent in a vehicle ad hoc network besides position information messages pertaining to the localization of individual subscriber nodes among one another for the purpose of describing the state of the vehicle ad hoc network and/or of a road on which the subscriber nodes are situated, the method comprising:

receiving one of the infrastructure description messages at a subscriber node, rating of the received infrastructure description message in respect of a need for reaction, and filtering of the rated infrastructure description message on the basis of a predetermined criterion for the need for reaction, the predetermined criterion containing a limiting condition for at least one of:

a redundancy in the infrastructure description message with respect to other infrastructure description messages received by the receiving subscriber node, a time period for ignoring the infrastructure description message transmitted from an identified transmitting subscriber node, and a type of the infrastructure description message indicated in the data packet.

2. The method as claimed in claim 1, wherein the need for reaction describes at least one potential with which the receiving subscriber node can react to the state description contained in the infrastructure description message.

3. The method as claimed in claim 2, wherein the predetermined criterion comprises a limiting condition with which the receiving subscriber node is intended to react to the state description contained in the infrastructure description message.

4. The method as claimed in claim 1, wherein the need for reaction describes at least one currentness for the state description in the infrastructure description message.

5. The method as claimed in claim 4, wherein the currentness for the state description contains whether the same infrastructure description message has been received once before.

6. The method as claimed in claim 4, wherein the predetermined criterion comprises a limiting condition for the currentness describing the state description in the infrastructure description message.

7. The method as claimed in claim 1, wherein the need for reaction contains at least one distance between the receiving subscriber node and a position contained in the state description of the infrastructure description message.

8. The method as claimed in claim 7, wherein the predetermined criterion contains a limiting condition for the distance between the receiving subscriber node and the position contained in the state description of the infrastructure description message.

9. A filter apparatus for performing a method as claimed in claim 1.

10. The method as claimed in claim 5, wherein the predetermined criterion comprises a limiting condition for the currentness describing the state description in the infrastructure description message.

11. A receiver for a vehicle for receiving messages, packed in data packets, with a transmission signal in a vehicle ad hoc network, comprising:

an antenna for receiving the transmission signal;

a filter for filtering a packetized infrastructure description message received in the transmission signal, the filtering being performed on the basis of a predetermined criterion for a need for reaction, the predetermined criterion containing a limiting condition for at least one of:

a redundancy in the infrastructure description message with respect to other infrastructure description messages received by the receiving subscriber node, a time period for ignoring the infrastructure description message transmitted from an identified transmitting subscriber node, and a type of the infrastructure description message indicated in the data packet; and a presentation apparatus for extracting the messages from the filtered data packets.

* * * * *